US009821992B2

(12) United States Patent
Rudick et al.

(10) Patent No.: US 9,821,992 B2
(45) Date of Patent: Nov. 21, 2017

(54) JUICE DISPENSING SYSTEM

(75) Inventors: Arthur G. Rudick, Atlanta, GA (US); David R. Newman, Atlanta, GA (US); Nilang Patel, Mableton, GA (US); Paul A. Phillips, Marietta, GA (US); Gregg Carpenter, Marietta, GA (US); Lawrence B. Ziesel, Woodstock, GA (US)

(73) Assignee: The Coca-Cola Company, Atlanta, GA (US)

( * ) Notice: Subject to any disclaimer, the term of this patent is extended or adjusted under 35 U.S.C. 154(b) by 653 days.

(21) Appl. No.: 11/276,549

(22) Filed: Mar. 6, 2006

(65) Prior Publication Data

US 2007/0205220 A1 Sep. 6, 2007

(51) Int. Cl.

| | |
|---|---|
| ***B67D 7/06*** | (2010.01) |
| ***B67D 1/00*** | (2006.01) |
| ***B67D 1/07*** | (2006.01) |

(52) U.S. Cl.

CPC ..... *B67D 1/0025* (2013.01); *B67D 1/0047* (2013.01); *B67D 1/07* (2013.01); *B67D 2210/0006* (2013.01)

(58) Field of Classification Search

CPC ..... B67D 1/0025; B67D 1/07; B67D 1/0034; B67D 1/0043; B67D 1/0044; B67D 1/0047

USPC ..... 222/129.2, 129.3, 129.4, 129.1, 145.1, 222/145.5, 145.6, 132, 1, 135, 144.5

See application file for complete search history.

(56) References Cited

U.S. PATENT DOCUMENTS

| | | | | |
|---|---|---|---|---|
| 1,684,258 | A * | 9/1928 | Boggs | 222/235 |
| 3,822,056 | A * | 7/1974 | Hawes et al. | 366/114 |
| 4,181,242 | A * | 1/1980 | Zygiel et al. | 222/1 |
| 4,676,401 | A | 6/1987 | Fox et al. | |
| 4,753,370 | A | 6/1988 | Rudick | |
| 4,779,761 | A | 10/1988 | Rudick et al. | |
| 4,793,520 | A | 12/1988 | Gerber | |
| 4,827,426 | A | 5/1989 | Patton et al. | |
| 4,830,511 | A | 5/1989 | Smazik | |
| 4,860,923 | A | 8/1989 | Kirschner et al. | |
| 4,881,663 | A | 11/1989 | Seymour | |
| 4,889,148 | A | 12/1989 | Smazik | |
| 4,923,093 | A | 5/1990 | Gerber | |
| 4,934,567 | A | 6/1990 | Vahjen et al. | |

(Continued)

FOREIGN PATENT DOCUMENTS

| | | |
|---|---|---|
| AT | 319795 | 1/1975 |
| DE | 37 09 155 A1 | 10/1987 |

(Continued)

OTHER PUBLICATIONS

Lancer, Redirect your store traffic from the cooler to your more profitable post-mix fountain area by adding fun and creating excitement!; FS Series (Apr. 2003); pp. 4.

*Primary Examiner* — J. Casimer Jacyna

(74) *Attorney, Agent, or Firm* — Eversheds Sutherland (US) LLP

(57) ABSTRACT

The present application describes a product mixing device. The product mixing device includes an ingredient combination chamber and means for agitation positioned about the ingredient combination chamber. The ingredient combination chamber includes a diluent inlet, a number of macro-ingredient inlets, a number of micro-ingredient inlets, and an outlet.

15 Claims, 9 Drawing Sheets

(56) References Cited

U.S. PATENT DOCUMENTS 4,955,507 A 9/1990 Kirschner et al.
5,087,864 A * 2/1992 Abel ..... 318/34
5,154,586 A 10/1992 Rudick
5,292,030 A 3/1994 Kateman et al.
5,340,211 A * 8/1994 Pratt ..... 366/141
5,341,957 A 8/1994 Sizemore
5,433,967 A 7/1995 Kateman et al.
5,465,870 A 11/1995 Sizemore
5,473,909 A 12/1995 Kateman et al.
5,507,415 A 4/1996 Sizemore
5,575,405 A * 11/1996 Stratton et al. ..... 222/1
5,588,557 A * 12/1996 Topar ..... 222/54
5,603,257 A 2/1997 Kateman et al.
5,673,820 A * 10/1997 Green et al. ..... 222/129.3
5,678,617 A * 10/1997 Kuykendal et al. ..... 141/392
5,704,350 A * 1/1998 Williams, III ..... 600/300
5,725,125 A 3/1998 Bessette et al.
5,727,713 A 3/1998 Kateman et al.
5,738,248 A * 4/1998 Green ..... 222/129.2
5,758,571 A 6/1998 Kateman et al.
5,778,761 A 7/1998 Miller
5,803,320 A * 9/1998 Cutting et al. ..... 222/641
5,855,296 A * 1/1999 McCann et al. ..... 222/61
5,865,221 A 2/1999 Ludwig et al.
5,868,065 A 2/1999 Haggerty et al.
5,878,964 A 3/1999 Hansen
5,890,626 A 4/1999 Wolski et al.
5,975,365 A * 11/1999 Hsieh ..... 222/129.4
5,980,969 A 11/1999 Mordini et al.
5,997,928 A 12/1999 Kaish et al.
6,098,524 A * 8/2000 Reese ..... 99/280
6,126,983 A 10/2000 Miller
6,170,707 B1 1/2001 Wolski et al.
6,173,862 B1 1/2001 Buca et al.
6,186,193 B1 2/2001 Phallen et al.
6,253,963 B1 7/2001 Tachibana
6,267,157 B1 * 7/2001 Gruson et al. ..... 141/90
6,350,484 B1 2/2002 Ault
6,421,583 B1 7/2002 Sudolcan et al.
6,435,375 B2 8/2002 Durham et al.
6,446,834 B2 9/2002 Davis et al.
6,496,752 B2 12/2002 Sudolcan et al.
6,536,626 B2 3/2003 Newman et al.
6,550,641 B2 4/2003 Newman et al.
6,550,642 B2 4/2003 Newman et al.
6,588,725 B1 7/2003 Wisnieski et al.
6,600,968 B2 7/2003 Sudolcan et al.
6,600,969 B2 7/2003 Sudolcan et al.
6,650,962 B2 11/2003 Sudolcan et al.
6,669,053 B1 12/2003 Garson et al.
6,689,410 B2 2/2004 Gerber
6,694,748 B2 2/2004 Sergio et al.
6,698,228 B2 3/2004 Kateman et al.
6,745,595 B1 6/2004 Kateman et al.
6,751,525 B1 6/2004 Crisp, III
6,756,069 B2 6/2004 Scoville et al.
6,763,860 B2 7/2004 Jungmann et al.
6,766,656 B1 7/2004 Crisp, III et al.
6,907,741 B2 6/2005 Kateman
6,934,602 B2 8/2005 Sudolcan et al.
6,941,858 B2 9/2005 Kateman
6,952,928 B2 10/2005 Kateman et al.
6,957,125 B1 10/2005 Rifkin
6,983,863 B2 1/2006 Santy, Jr.
6,994,231 B2 * 2/2006 Jones ..... 222/129.1
7,077,290 B2 7/2006 Bethuy et al.
7,108,024 B2 9/2006 Navarro
7,108,156 B2 9/2006 Fox
7,147,131 B2 12/2006 Sher et al.
7,156,115 B2 1/2007 Everett et al.
7,156,259 B2 1/2007 Bethuy et al.
7,159,743 B2 1/2007 Brandt et al.
7,162,391 B2 1/2007 Knepler et al.
7,164,966 B2 1/2007 Sudolcan
7,168,593 B2 1/2007 Schroeder et al.
7,203,572 B2 4/2007 Crisp, III
7,243,818 B2 * 7/2007 Jones ..... 222/129.1
7,320,416 B2 1/2008 Miller et al.
7,325,485 B2 2/2008 Carhuff et al.
7,331,483 B2 2/2008 Bhimani
7,334,706 B2 * 2/2008 Schroeder et al. ..... 222/148
7,347,344 B2 3/2008 Engels et al.
7,353,080 B2 4/2008 Walker et al.
7,640,755 B1 1/2010 Kateman
2002/0148858 A1 * 10/2002 Bertone ..... 222/129.4
2003/0012864 A1 1/2003 Gerber
2003/0097314 A1 5/2003 Crisp, II et al.
2003/0227820 A1 12/2003 Parrent
2004/0026447 A1 2/2004 Badin et al.
2004/0026452 A1 2/2004 Santiago et al.
2004/0040983 A1 3/2004 Ziesel
2004/0071841 A1 * 4/2004 Carhuff et al. ..... 426/250
2004/0103033 A1 5/2004 Reade et al.
2004/0170727 A1 9/2004 Howard et al.
2004/0217129 A1 11/2004 Roekens et al.
2005/0029287 A1 2/2005 Mobbs
2005/0121466 A1 6/2005 Sher et al.
2005/0166761 A1 8/2005 Jones et al.
2005/0166766 A1 8/2005 Jones et al.
2005/0175767 A1 8/2005 Gerber
2005/0178793 A1 8/2005 Cheng et al.
2005/0201196 A1 9/2005 Gerber
2005/0269360 A1 12/2005 Piatnik et al.
2005/0284885 A1 * 12/2005 Kadyk et al. ..... 222/129.1
2006/0036454 A1 2/2006 Henderson
2006/0043008 A1 * 3/2006 Joulakian ..... 210/110
2006/0051296 A1 * 3/2006 Holahan ..... 424/9.41
2006/0054614 A1 3/2006 Baxter et al.
2006/0081653 A1 4/2006 Bolland et al.
2006/0157504 A1 7/2006 Barker et al.
2006/0172056 A1 8/2006 Tobin et al.
2006/0174778 A1 8/2006 Greiwe
2006/0180610 A1 8/2006 Haskayne
2006/0191964 A1 8/2006 Ziesel
2006/0213928 A1 9/2006 Ufheil et al.
2007/0009365 A1 1/2007 Litterst et al.
2007/0051747 A1 3/2007 Landers et al.
2007/0080169 A1 4/2007 Sher et al.
2007/0114243 A1 5/2007 Kershaw et al.
2007/0114244 A1 * 5/2007 Gatipon et al. ..... 222/129.1
2007/0131715 A1 6/2007 Minard et al.
2007/0205221 A1 9/2007 Carpenter et al.
2007/0251260 A1 11/2007 Baxter et al.
2007/0255450 A1 11/2007 Mazur et al.
2007/0272317 A1 11/2007 Klopfenstein et al.
2008/0004954 A1 1/2008 Horvitz
2008/0023488 A1 1/2008 Guerrero et al.
2008/0029541 A1 2/2008 Wallace et al.
2008/0041876 A1 2/2008 Frank et al.
2008/0050480 A1 2/2008 Doglioni Majer
2008/0142548 A1 6/2008 Moen et al.
2008/0302818 A1 * 12/2008 Minard et al. ..... 222/1

FOREIGN PATENT DOCUMENTS

EP 0104447 A2 4/1984
EP 0105017 B1 4/1984
EP 0112638 A2 7/1984
EP 0136005 A1 4/1985
EP 0158096 A2 10/1985
EP 0175815 A2 4/1986
EP 0786948 B1 8/1997
EP 0083467 A1 7/1998
EP 0958234 B1 11/1999
EP 1038829 9/2000
EP 1317376 A1 6/2003
EP 1460029 9/2004
EP 1910095 2/2008
EP 1905730 4/2008
FR 2866538 8/2005
GB 2429694 9/2005
GB 2429694 7/2007
GB 2442223 4/2008
JP 55-048419 U 9/1953

(56) References Cited

FOREIGN PATENT DOCUMENTS

| | | | |
|---|---|---|---|
| JP | 58-124885 | U | 8/1983 |
| JP | 61-107082 | U | 7/1985 |
| JP | 2-004697 | A | 1/1990 |
| JP | 6-339362 | A | 12/1994 |
| JP | 09134481 | | 5/1997 |
| JP | 2000-272698 | A | 10/2000 |
| JP | 2001-269562 | A | 10/2001 |
| WO | 8809766 | | 12/1988 |
| WO | 9850165 | A1 | 11/1998 |
| WO | 00/68136 | | 5/2000 |
| WO | 0065316 | A1 | 11/2000 |
| WO | 02059035 | A2 | 8/2002 |
| WO | 03107110 | A1 | 12/2003 |
| WO | 2004036515 | A1 | 4/2004 |
| WO | 2005018788 | A1 | 3/2005 |
| WO | 2005/068836 | | 7/2005 |
| WO | 02/057178 | | 8/2005 |
| WO | 2005/070816 | | 8/2005 |
| WO | 2005/102906 | | 11/2005 |
| WO | 2005/111955 | | 11/2005 |
| WO | 2005111955 | A1 | 11/2005 |
| WO | 2006/012916 | | 2/2006 |
| WO | 2006/013362 | | 2/2006 |
| WO | 2006/019523 | | 2/2006 |
| WO | 2006/024409 | A2 | 3/2006 |
| WO | 2006/076733 | | 7/2006 |
| WO | 2006/070257 | | 10/2006 |
| WO | 2007/002575 | | 1/2007 |
| WO | 2007/070032 | | 6/2007 |
| WO | 2008/015097 | | 2/2008 |

* cited by examiner

JUICE DISPENSING SYSTEM

TECHNICAL FIELD

The present application relates generally to beverage dispenser and more particularly relates to a juice dispenser or a beverage dispenser capable of dispensing a number of different beverage alternatives.

BACKGROUND OF THE INVENTION

Commonly owned U.S. Pat. No. 4,753,370 concerns a "Tri-Mix Sugar Based Dispensing System." This patent describes a beverage dispensing system that separates the highly concentrated flavoring from the sweetener and the diluent. This separation allows for the creation of numerous beverage options using several flavor modules and one universal sweetener. One of the objectives of the patent is to allow a beverage dispenser to provide as many beverages as may be available on the market in prepackaged bottles or cans. U.S. Pat. No. 4,753,370 is incorporated herein by reference.

These separation techniques, however, generally have not been applied to juice dispensers. Rather, juice dispensers typically have a one-one correspondence between the juice concentrate stored in the dispenser and the products dispensed therefrom. As such, consumers generally can only choose from a small number of products given the necessity of significant storage space for the concentrate. A conventional juice dispenser thus requires a large footprint in order to offer a wide range of different products.

Another issue with known juice dispensers is that the last mouthful of juice in the cup may not be properly mixed such that a large slug of undiluted concentrate may remain. This problem may be caused by insufficient agitation of the viscous juice concentrate. The result often is an unpleasant taste and an unsatisfactory beverage.

Thus, there is a desire for an improved beverage dispenser system that can accommodate a wide range of different beverages. Preferably, the beverage dispenser can offer a wide range of juice-based products within a reasonable footprint. Further, the products offered by the beverage dispenser should be properly mixed throughout the beverage.

SUMMARY OF THE INVENTION

The present application thus describes a product mixing device. The product mixing device may include an ingredient combination chamber and means for agitation positioned about the ingredient combination chamber. The ingredient combination chamber may include a diluent inlet, a number of macro-ingredient inlets, a number of micro-ingredient inlets, and an outlet.

The product mixing device further may include a number of macro-ingredient sources with reconstitution ratios in the range of about three to one (3:1) to about six to one (6:1) and a number of micro-ingredient sources with reconstitution ratios in the range of about ten to one (10:1) or higher. The product mixing device further may include a number of pumping or metering devices in communication with the water inlet, the macro-ingredient inlets, and the micro-ingredient inlets. The water inlet, the macro-ingredient inlets, and the micro-ingredient inlets may include a check valve therein. A number of ingredient combination chambers may be used.

The means for agitation may include a static mixer, an orifice positioned in the outlet, an impingement surface positioned about the orifice, a motorized agitator, or a passive mechanical agitator. The motorized agitator may include a propeller driven by a motor. The passive mechanical agitator may include a propeller positioned about a narrow chamber entrance.

The product mixing device further may include a flush diverter positioned downstream of the agitator. The flush diverter may include a pivoting flow diverter or a linear diverter positioned about a drain. The linear diverter may include a drawer operated by a solenoid.

The product mixing device further may include a user interface. The user interface may include a number of product selections a number of product use indicators to indicate that a product has been selected, a number of additive selections, a number of portion selections, a number of intensity selections, and a consumer data system. The consumer data system may include a communications device. The consumer data system may include a biometric sensor.

The present application further describes a method of preparing a product. The method may include the steps of selecting one or more base products, selecting one or more additives, dispensing the one or more base products and the one or more additives into a chamber, dynamically agitating the one or more base products and the one or more additives to create the product, and dispensing the product. The method further may include selecting the intensity of the base products or the additives. The method further may include receiving consumer information prior to the selecting steps.

The present application further describes a product dispenser. The product dispenser may include at least one macro-ingredient source, at least one micro-ingredient source, a diluent source, and an ingredient chamber; a number of pumps or metering devices positioned between the macro-ingredient source, the micro-ingredient source, the diluent source, and the ingredient chamber; and a user interface for receiving a request for a product type and instructing the pumps or metering devices to dispense a predetermined type and ratio of macro-ingredients, micro-ingredients, and diluent to the ingredient chamber for a predetermined flow rate.

The product dispenser further may include means for flushing the ingredient chamber. The product dispenser further may include means for agitation positioned downstream of the ingredient chamber.

The user interface may include a number of product selections, a number of additive selections, and a number of intensity selections. The user interface dispenses the predetermined type and ratio of macro-ingredients, micro-ingredients, and water to the ingredient chamber for the predetermined flow rate. The product dispenser further may include a consumer data system.

These and other features of the present application will become apparent to one of ordinary skill in the art upon review of the following detailed description of the invention when taken in conjunction with the several drawings and the appended claims.

DETAILED DESCRIPTION

Figure 1:
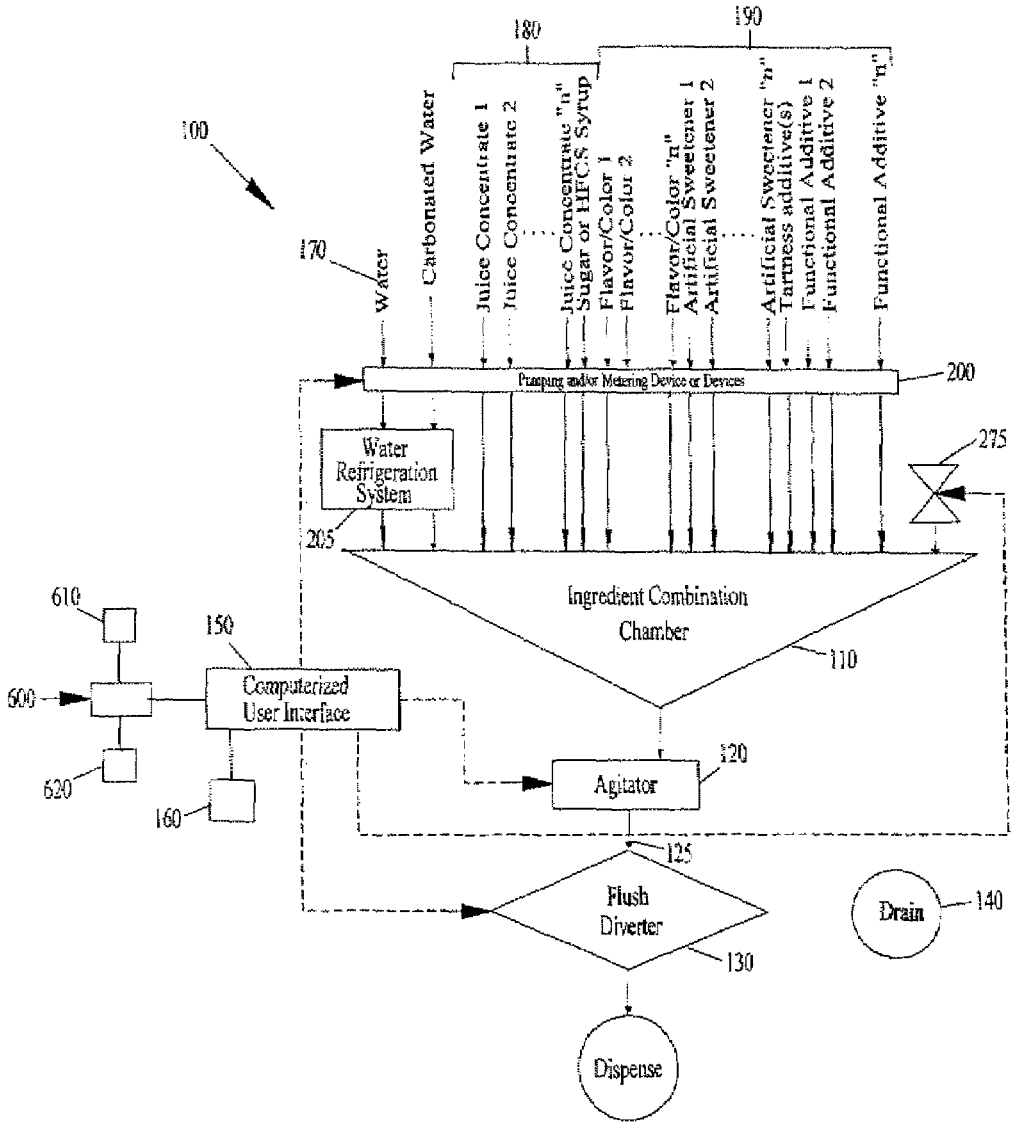
FIG. 1 is a schematic view of a beverage dispenser as is described herein.

Referring now to the drawings, in which like numerals indicate like elements throughout the several views, FIG. 1 shows a beverage dispenser 100 as is described herein. Generally described, the beverage dispenser 100 includes an ingredient combination chamber 110. The ingredient combination chamber 110 functions as a manifold with numerous inlets and one outlet such that any number of ingredients can be combined into one stream. An agitator 120 may be positioned downstream of the ingredient combination chamber 110. The agitator 120 thoroughly mixes the ingredients. Downstream of the agitator 120 via an exit tube 125 may be a flush diverter 130 in communication with a drain 140. The exit tube 125 also may include any type of dispensing equipment and may be referred to as the dispenser head.

A user interface 150 controls all functional aspects of the beverage dispenser 100. The consumer may select and/or create numerous types of beverages and blends using the user interface 150, A conventional control device 160 may support the user interface 150. The control device 160 may be a conventional microcomputer or a similar type of device. The control device 160 may be internal to or remote from the beverage dispenser 100.

The beverage dispenser 100 may use any number of different ingredients. In this example, several different types of ingredients may be used: water 170 from a water source (plain or carbonated), macro-ingredients 180 from a number of macro-ingredient sources, and micro-ingredients 190 from a number of micro-ingredient sources. Generally described, the macro-ingredients 180 have reconstitution ratios in the range of about three to one (3:1) to about six to one (6:1). Macro-ingredients 180 may include juice concentrates, sugar syrup, HFCS (High Fructose Corn Syrup) syrup, or similar types of materials. Similarly, a macro-ingredient base product may include sweetener, acid, and other common components. The juice concentrates generally require refrigeration. The sugar, HFCS, or base products syrup can be stored in a conventional bag in box container remote from the dispenser 100. The viscosities of the macro-ingredients 180 typically range about 100 centipoise or higher.

The micro-ingredients 190 may have a reconstitution ratio ranging of about ten to one (10:1), twenty to one (20:1), thirty to one (30:1), or higher. The viscosities of the micro-ingredients 190 would typically range from about 1 to about 100 centipoise or so, but may vary from this range. Examples of micro-ingredients 190 include natural or artificial flavors; flavor additives; natural or artificial colors; sweeteners (synthetic or natural, high potency or otherwise); additives for controlling tartness, e.g., citric acid or potassium citrate; functional additives such as vitamins, minerals, herbal extracts; nutraceuticals; and over the counter (or otherwise) medicines such as Acetaminophen; and similar types of materials. Various types of alcohols may be used as micro or macro-ingredients. The micro-ingredients 190 may be in liquid, powder (solid), or gaseous form and/or combinations thereof. The micro-ingredients 190 may or may not require refrigeration. Non-beverage substances such as paints, dyes, oils, cosmetics, etc., also may be used. Any type of conventional container may be used for the ingredients 180, 190.

The water 170, the macro-ingredients 180, and the micro-ingredients 190 may be in communication with the ingredient combination chamber 110 via a number of pumping and/or metering devices 200. One pump/metering device 200 might handle one ingredient or multiple ingredients. The pump/metering devices 200 for the macro-ingredients 180 may be of conventional design. The pump/metering devices 200 for the micro-ingredients 190 may be positive displacement pumps or similar types of devices so as to provide accurate amounts of relatively small doses of the micro-ingredients 190. A water refrigeration system 205 also may be used if desired.

Figure 2:
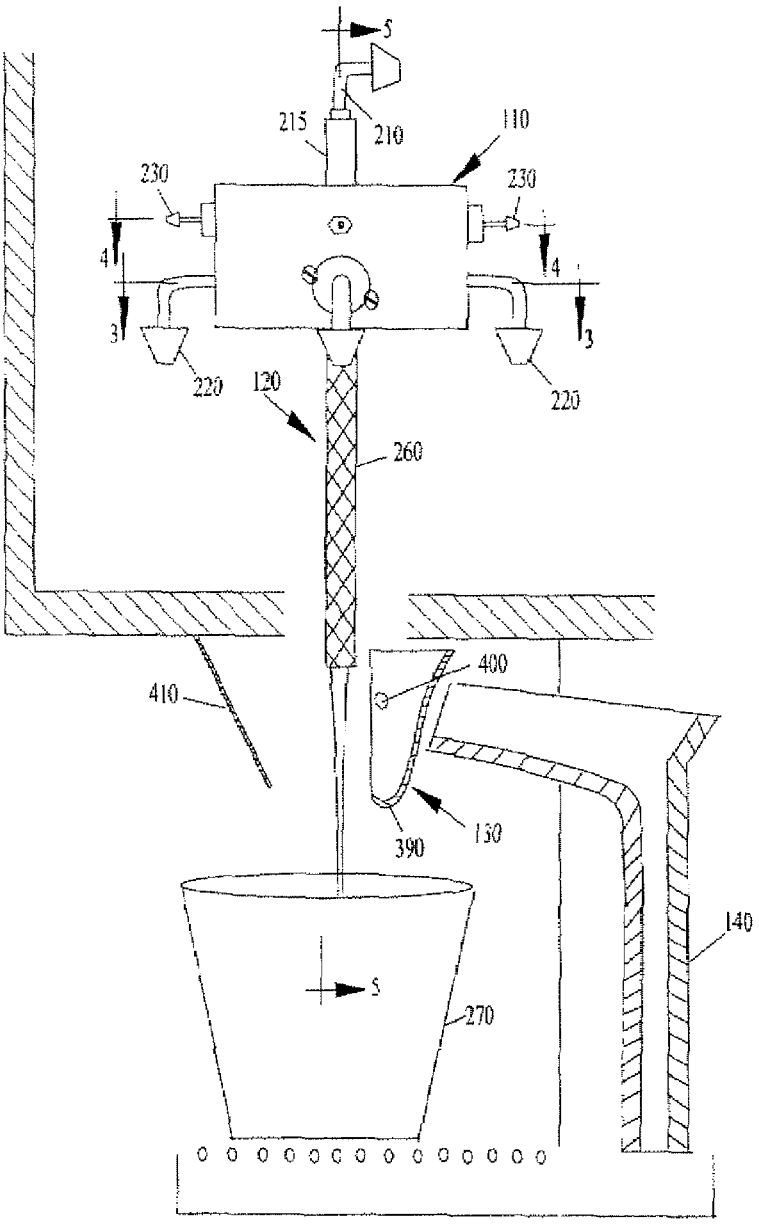
FIG. 2 is a side cross-sectional view of the beverage dispenser as described herein.
Figure 3:
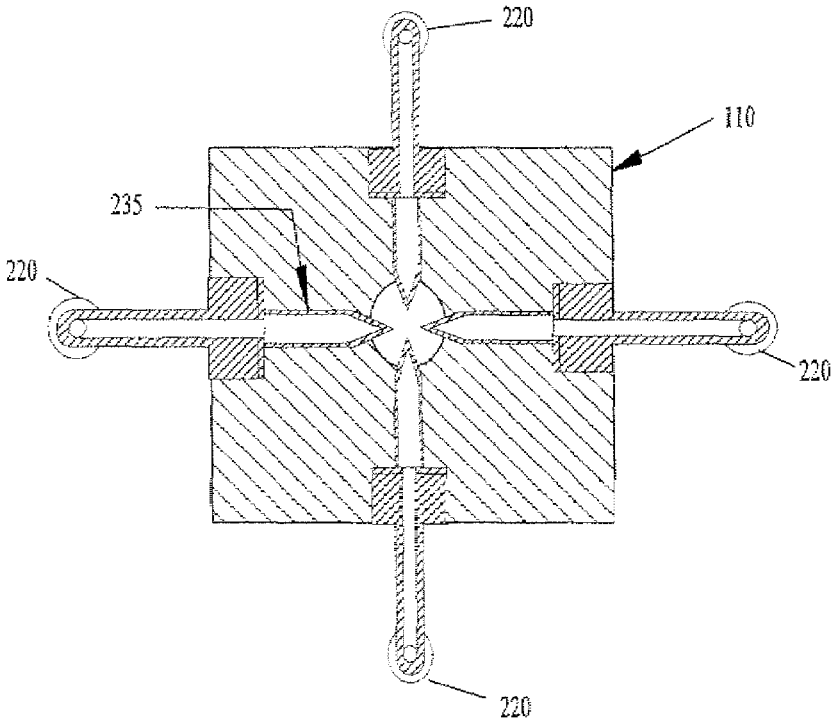
FIG. 3 is a further side cross-sectional view of the beverage dispenser of FIG. 2.
Figure 4:
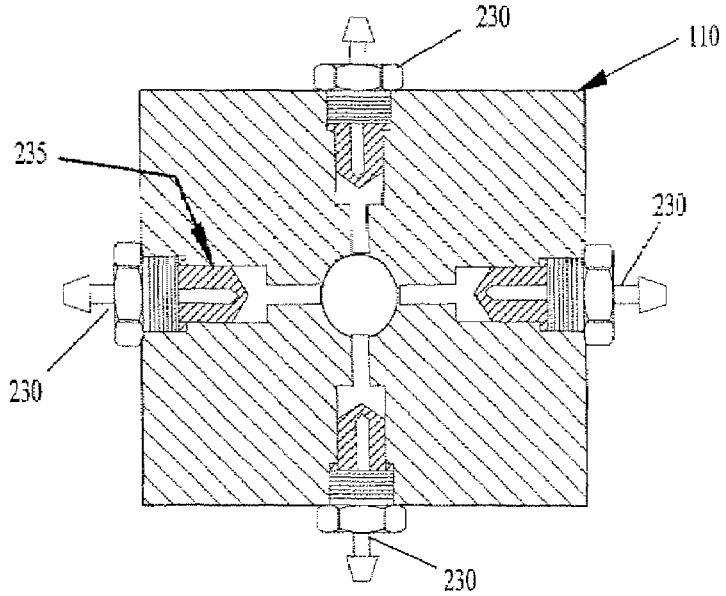
FIG. 4 is a further side cross-sectional view of the beverage dispenser of FIG. 2.
Figure 5:
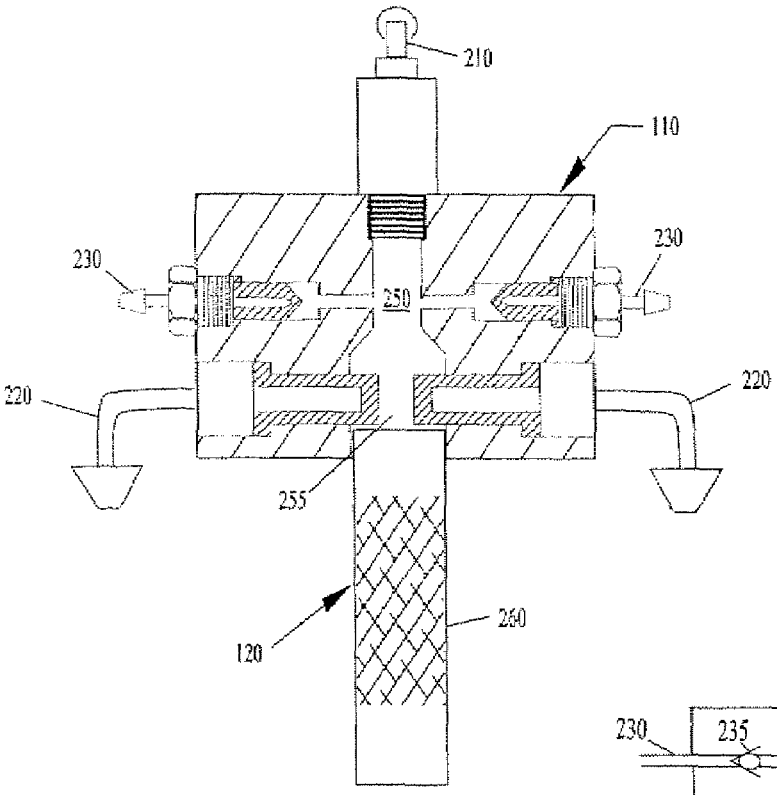
FIG. 5 is a further side cross-sectional view of the beverage dispenser of FIG. 2.

FIGS. 2-5 show an example of an ingredient combination chamber 110. The ingredient combination chamber 110 may be made out of injection molded plastic or similar types of noncorrosive materials. As is shown in FIG. 2, the ingredient combination chamber 110 may have several types of inlets: a water inlet 210; a number of macro-ingredient inlets 220; and a number of micro-ingredient inlets 230. The inlets 210, 220, 230 may be standard barbed fittings or similar types of connection devices. The water inlet 210 may include a standard check valve 215 therein. Likewise, the macro-ingredient inlets 220 and the micro-ingredient inlets 230 may include an internal duckbill check valves 235 or similar types of backflow prevention devices. The inlets 210, 220, 230 may be removable. The macro-ingredient inlets 220 are shown to be larger than the micro-ingredient inlets 230, but any convenient size may be used. Likewise, although four (4) macro-ingredient inlets 220 and four (4) micro-ingredient inlets 230 are shown, any number of inlets 220, 230 may be used.

Figure 6:
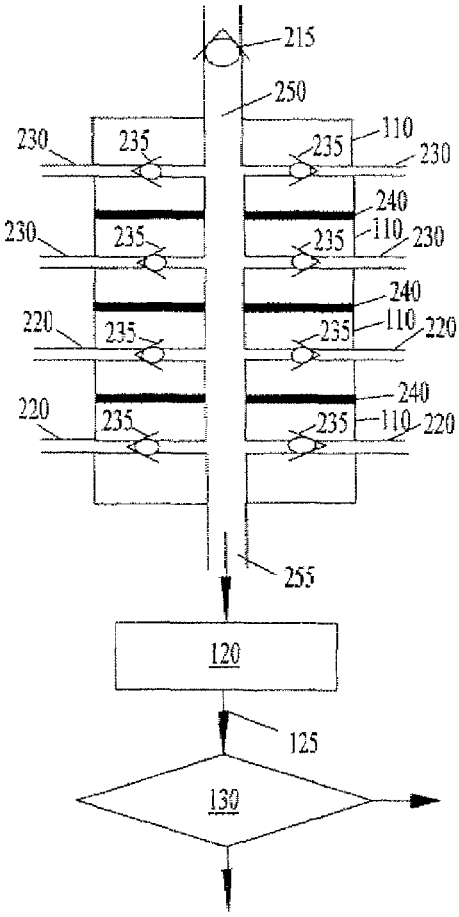
FIG. 6 is a side cross-sectional view of an alternative embodiment of the beverage dispenser of FIG. 2.

As is shown in FIG. 6, multiple ingredient combination chambers 110 may be stacked together with a sealing layer 240 there between. The sealing layer 240 may be made out of ethylene propylene dimonomer (EPDM) rubber, polyurethane, or similar types of materials. Any number of ingredient combination chambers 110 may be used together so as to provide for any number of ingredients 180, 190 in any combination. Other configurations may be used herein.

In this embodiment, the inlets 210, 220, 230 may lead to a central chamber 250. The central chamber 250 may be shaped as a vertical tube. The inlets 220, 230 are arranged so as to maximize the density of the inlets along the length of the central chamber 250 without restricting the flow through the chamber 250. The central chamber 250 preferably should have no impediments therein that may trap pulp or pockets of ingredients. The central chamber 250 leads to a single outlet 255 at the bottom end or the low point of the chamber 250. Other variations of the ingredient combination chamber 110 may be used herein.

The outlet 255 may lead to the agitator 120. In this embodiment of FIG. 2, the agitator 120 may take the form of a static mixer 260. The static mixer 260 may be a vertical tube with a number of internal baffles or other structures. The static mixer 260 splits the incoming liquid flow and creates a vortex. The vortex is then sheared and reoccurs in the opposite direction thus thoroughly mixing the liquid with a clockwise/counterclockwise motion. An example of a static mixer is sold by Cole-Parmer Instrument Company of Vernon Hills, Ill. In sum, the water 170 and the ingredients 180, 190 flow through the inlets 210, 220, 230, mix within the central chamber 250, further mix in the static mixer 260, and then are dispensed into a consumer's cup 270.

The ingredient combination chamber 110 further may include a vent port 275. The vent port 275 may include an internal valve. The valve may be operated by a solenoid or similar type of device. The vent port 275 may be positioned about the highest point of the ingredient combination chamber 110 so as to ensure that liquid does not exit therethrough. After a dispense or a flush cycle, the central chamber 250 may remain full of liquid. The vent port 275 thus may actuate so as to break the vacuum supporting the liquid and allowing the liquid to drain.

Figure 7:
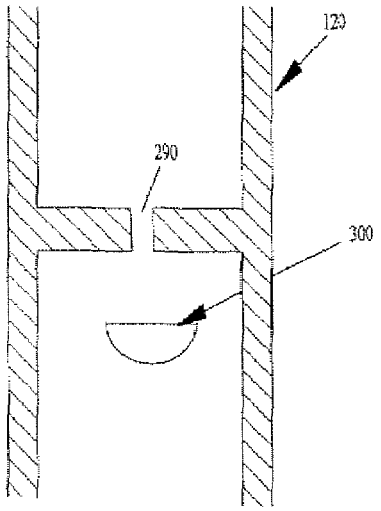
FIG. 7 is a side cross-sectional view of an orifice and an impingement surface for use with the beverage dispenser of FIG. 2.

FIG. 7 shows two alternatives of the agitator 120. Instead of the static mixer 260, the agitator 120 may simply include an orifice 290 positioned within the outlet 255 of the ingredient combination chamber 110. The orifice 290 forces the outgoing fluid stream to leave at a high velocity such that mixing is accomplished within the consumer's cup 270 due to the turbulence caused by the energy of the outgoing fluid stream.

FIG. 7 also shows the use of an impingement surface 300. The impingement surface 300 may take any convenient shape and may be located directly under the orifice 290. As the outgoing fluid stream exits the orifice 290 at high velocity and hits the impingement surface 300, turbulence is created such that the fluid stream begins to mix. The thoroughly mixed fluid thus exits via the bottom of the tube 125 and enter the consumer's cup 270.

Figure 8:
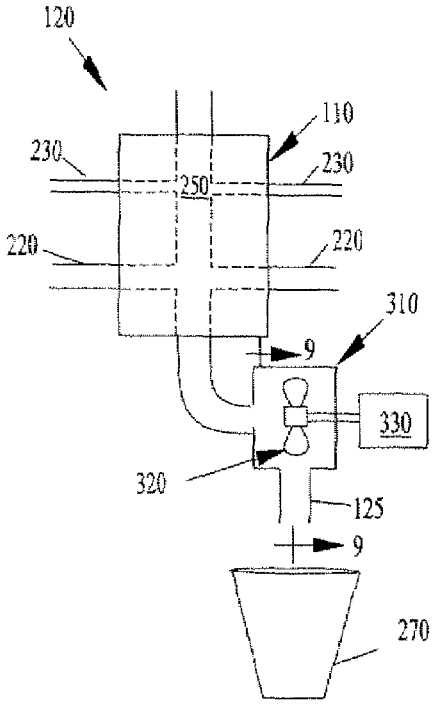
FIG. 8 is a side cross-sectional view of an agitation chamber for use with the beverage dispenser of FIG. 2.
Figure 9:
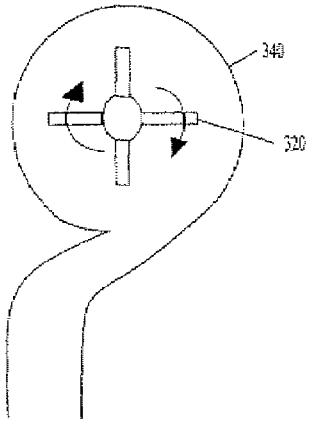
FIG. 9 is a further side cross-sectional view of the agitation chamber of FIG. 8.

FIGS. 8 and 9 show a further dynamic embodiment of the agitator 120, a motorized agitator 310. The motorized agitator 310 includes a propeller-like agitator 320 driven by a motor 330. The motor 330 may be a conventional DC motor or a similar type of device. The propeller agitator 320 may be positioned within an agitation chamber 340. The agitation chamber 340 is positioned along the exit tube 125. The propeller agitator 320 is designed such that it does not catch pulp and such that cleaning solution can contact all surfaces of the propeller agitator 320 and the agitation chamber 340. The agitation chamber 340 is designed such that Juice drains from the lowest point of the chamber 340. The juice or other fluid stream is mixed thoroughly by the agitator propeller 320. The agitator propeller 320 may operate at about 600 to about 1200 revolutions per minute. (Depending upon the nature of the beverage, the propeller 320 may be operated at a reduced speed or not operated at all so to minimize, for example, carbonation breakout.) The thoroughly mixed fluid thus exits via the bottom of the tube 125 and enter the consumer's cup 270.

Figure 10:
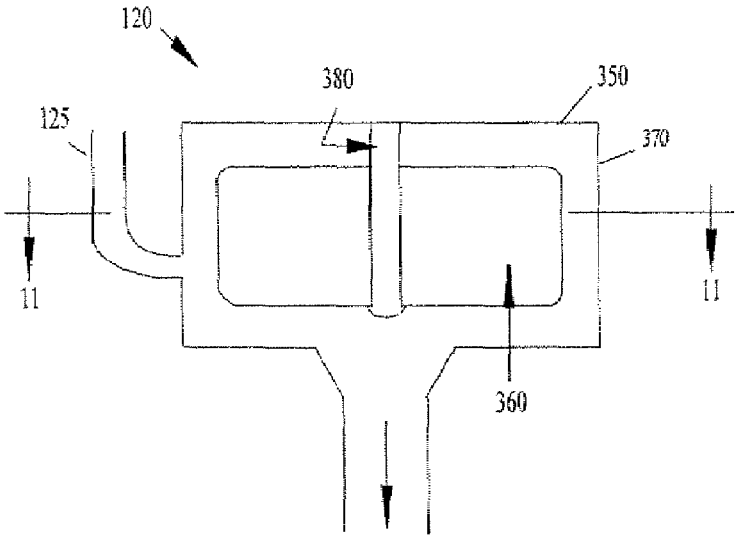
FIG. 10 is a side cross-sectional view of an alternative agitation chamber for use with the beverage dispenser of FIG. 2.
Figure 11:
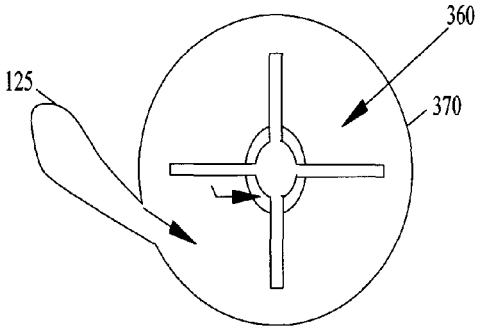
FIG. 11 is a further side cross-sectional view of the agitation chamber of FIG. 10.

FIGS. 10 and 11 show a further embodiment of the agitator 120, a passive mechanical agitator 350. The passive mechanical agitator 350 includes a propeller agitator 360 positioned within an agitator chamber 370. The propeller 360 may be positioned within the chamber 370 via a shaft 380. The outlet tube 125 may narrow upon approach to the chamber 370 so as to increase the speed of the fluid stream therein. The fluid stream enters the chamber 370 and hits the propeller agitator 360 in a tangential direction so as to turn the propeller agitator 360. This agitation adds kinetic energy that thoroughly mixes the fluid stream. The thoroughly mixed fluid thus exits via the bottom of the tube 125 and enter the consumer's cup 270. Other variations on the agitator 120 may be used herein. For example, gas or liquid stream agitation also may be used herein.

Referring again to FIG. 2, an example of the flush diverter 130 is shown in the dispense position. When the flush diverter 130 is in the "dispense" position, the ingredients are routed directly therethrough. Between dispenses, the flush diverter 130 may be moved to a "flush" position such that a water flush may be used to cleanout thoroughly the ingredients from the previous dispense.

Figure 12:
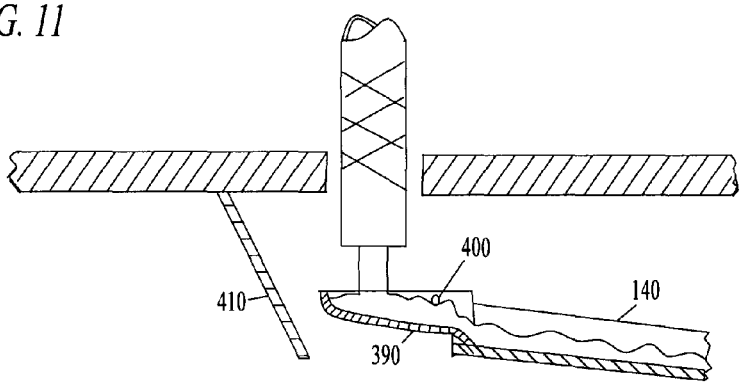
FIG. 12 is a side cross-sectional view of a flush diverter for use with the beverage dispenser of FIG. 2.

The flush diverter 130 may include a flow diverter 390. The flow diverter 390 may be operated by a solenoid or a similar type of device. The flow diverter 390 is positioned about a pivot 400. The solenoid thus pivots the flow diverter 390 from the dispense position shown in FIG. 2 to a flush position shown in FIG. 12. In the flush position, the Row diverter 390 directs the fluid stream to the flush drain 140. The flow diverter 390 may be positioned behind a decorative nozzle facade 410 such that the consumers do not see the water flush.

Figure 13:
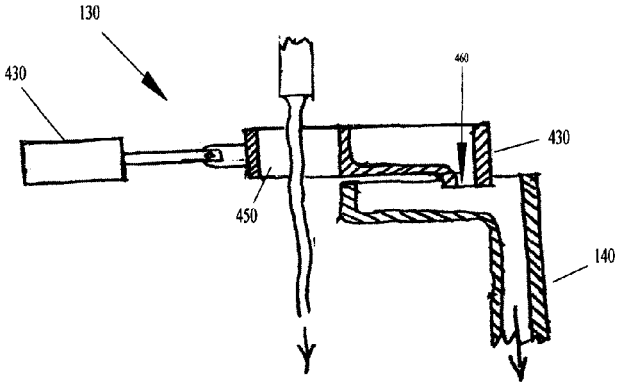
FIG. 13 is a side cross-sectional view of an alternative embodiment of the flush diverter for use with the beverage dispenser of FIG. 2.
Figure 14:
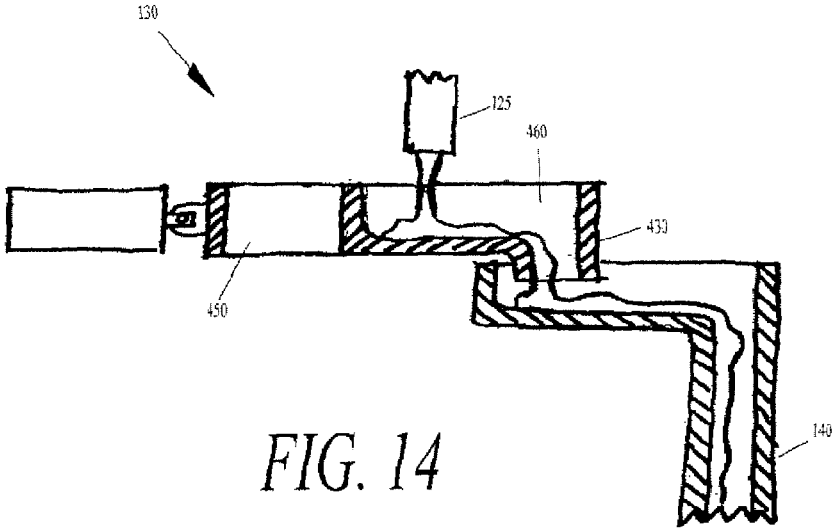
FIG. 14 is a further side cross-sectional view of the flush diverter of FIG. 13.

A further embodiment of the flush diverter 130 is shown in FIGS. 13 and 14, a drawer diverter 420. The drawer diverter 420 includes a flush drawer 430 positioned about the outlet tube 125 and the drain 140. The flush drawer 430 also may be operated by a solenoid 440. The flush drawer 430 includes a dispense position and a flush position. Specifically, the first end of the drawer 430 has an open bottom 450. The second end of the drawer 430 has a slightly slopping bottom that extends to a drain opening 460. When the solenoid 440 is de-energized, the first end of the drawer 430 with the open bottom 450 is directly below the outlet tube 125 so as to allow the fluid stream to flow into the consumer's cup 270. When the solenoid 440 is energized, it moves the drawer 430 to the second position with the drain opening 460. The fluid stream thus falls into the drain opening 460 and the drain 140.

A further embodiment of the flush diverter 130 is a conventional three-way solenoid diverter valve. An example of such a valve is available from Valcor Engineering Corp. of Springfield, N.J. Other variations on the flush diverter 130 may be used herein. The flush diverter 130 may have a clog detection system.

The viscosity of the fluid streams herein can range from about one (1) to about 5000 centipoise or higher. Even if the beverage dispenser system 100 as a whole drains thoroughly, there still may be some ingredients that cling to the interior of the beverage dispenser 100 by virtue of surface tension. These ingredients could remain into the next drink creating an off taste, off color, or trace amounts of non-requested additives in the next drink. The flush diverter 130 thus may be activated after each beverage.

Alternatively or in addition, the flush diverter 130 could be used before each beverage. Use of the flush diverter 130 may be based upon the ingredients within the beverage. The flush diverter 130 also may be used for end of the day or periodic cleaning with the use of a sanitation solution.

Figure 15:
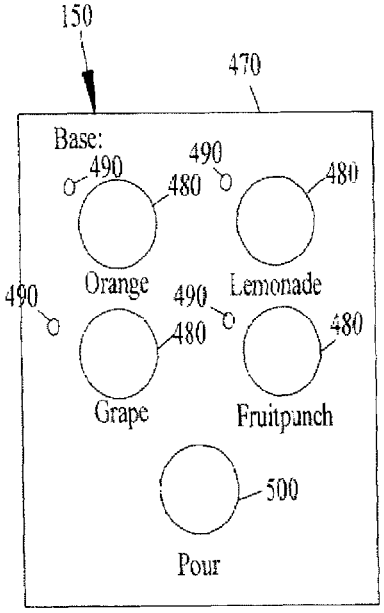
FIG. 15 is a schematic view of a user interface for use with the beverage dispenser of FIG. 2.

FIG. 15 shows an embodiment of the computer user interface 150, an interface 470. The interface 470 includes a set of predefined product buttons 480. Each button 480 may represent a different base product or product component. Each button 480 may have a use indicator 490. The use indicator 490 will signal to the consumer that a certain ingredient has been selected. As more ingredients are selected, the percentages of each are adjusted appropriately to achieve a predefined blend. As a result, a consumer may select a single base blended product like orange juice, a dual based product that may include parts of orange juice and lemonade, or a quad based product that would include four parts such as orange, lemonade, grape, and fruit punch. Any number of combinations may be used herein. A pour button 500 also may be used so as to activate the beverage dispenser 100 for the selected beverage.

Figure 16:
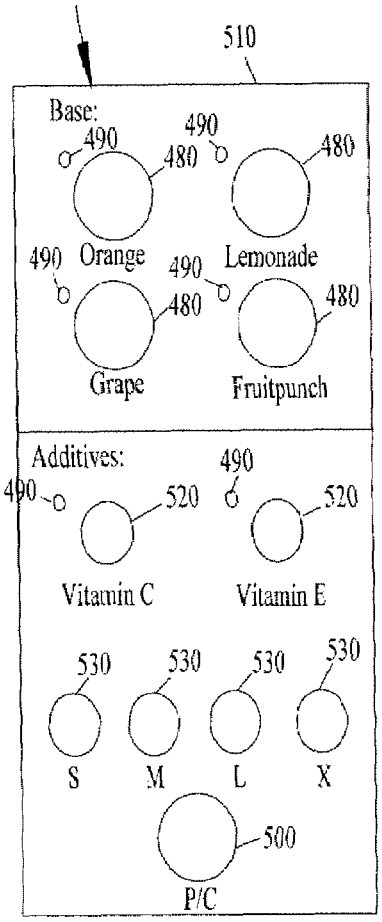
FIG. 16 is a schematic view of an alternative user interface for use with the beverage dispenser of FIG. 2.

FIG. 16 shows a further embodiment of the computer user interface 150, an interface 510. Similar to the interface 470, the interface 510 has the products buttons 480 and the use indicators 490. The interface 510 further includes additive buttons 520 and portion buttons 530. In addition to the predefined beverage blends described above, the additive buttons 520 provide the addition of additives such as vitamins and the like. Typically, the additives will not be added until about eighty percent (80%) of the minimum drink size is poured so as to guarantee that there is no overdose affect if the drink is stopped prematurely. Additives generally would not be added for top offs as the known drink size is not guaranteed. In the event that the user presses the pour cancel button, the additives would not be dispensed. The use indicator 490 may flash whenever the additive is being provided. The user interface 510 thus gives visible feedback to the consumer. The portion buttons 480 may be conventional "small", "medium", "large", "extra-large", and the like that correspond to predeterminne beverage sizes.

Figure 17:
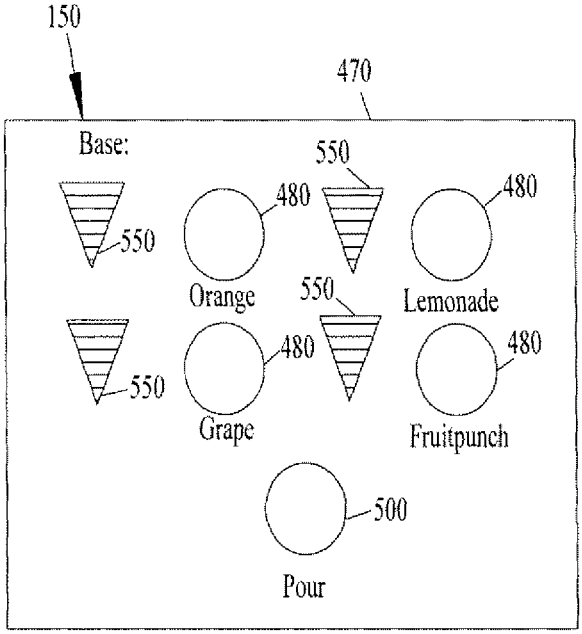
FIG. 17 is a schematic view of an alternative user interface for use with the beverage dispenser of FIG. 2.

FIG. 17 shows a further embodiment of the computer user interface 150, an interface 540. In addition to the product buttons 480, the interface 540 may include intensity indicators 550. The intensity indicator 550 may include LED's (Light Emitting Diodes) or similar types of visual interfaces that show the relative strength of the beverage. For example, if one beverage is selected, the intensity indicator 550 would be fully illuminated to indicate 100%. If a second base is selected, the intensity indicator 550 would be one-half illuminated to indicate a fifty percent (50%) portion. If the second strength is increased the first strength must be decreased. The entire interface 550 always shows a 100% strength summation. The relative strengths may be adjusted to any desired extent such as 50/50, 40/60, 30/70, etc. A custom blended beverage thus may be produced. The intensity indicator 550 also may be used to vary the amount of additives or even the nature and amount of the concentrate, sweetener, or other types of ingredients 180, 190.

Figure 18:
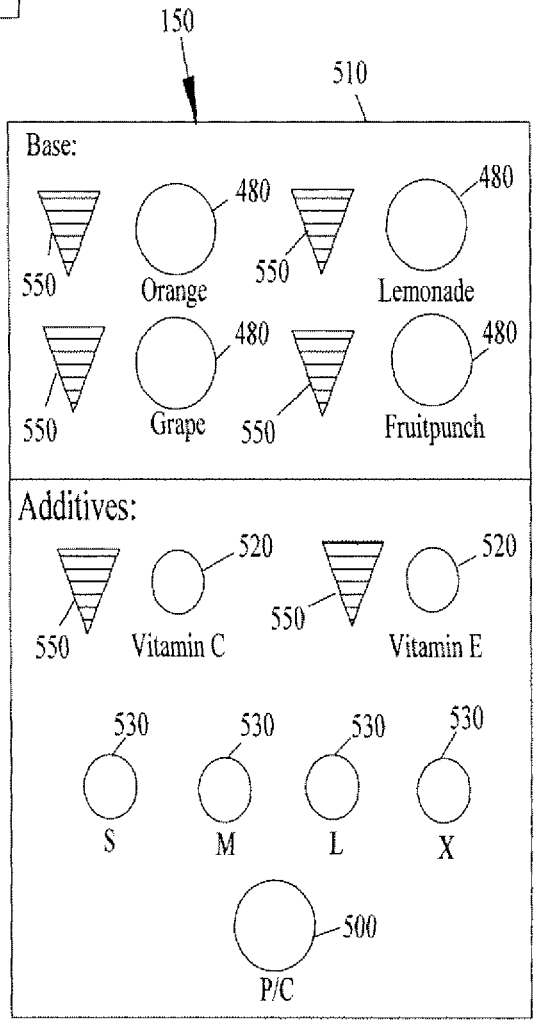
FIG. 18 is a schematic view of an alternative user interface for use with the beverage dispenser of FIG. 2.

FIG. 18 shows a further embodiment of the computer user interface 150, an interface 560. The interface 560 combines the embodiments described above such as the product buttons 480, the use indicator 490, the additive buttons 520, the pour button 500, the portion buttons 530, and the intensity indicators 550. Other types of indicators may be used herein.

In addition to the interfaces described above, additional graphical interfaces may be provided. For example, nutritional information may be provided. Whenever a portion button 530 or an intensity button 550 is selected, nutritional information that reflects the characteristics of the selected drink may be displayed. For example, the amount of calories in a beverage as mixed by the consumer may be displayed. The consumer may then have the option to change the nutritional value of the desired beverage. The computer user interface 150 also may restrict and/or allow which and how much of various ingredients may be used.

The computer user interface 150 may provide an individual consumer with secure access by password, smart card, biometric identification, credit card, RID, or otherwise. The user interface 150 may provide the consumer with formulations previously selected, promotions, and other types of information. The user interface 150 may restrict and/or allow which and how much of various ingredients may be used by a consumer. Consumer preferences also may be retained and used for new product development.

In addition to the graphical interface, the beverage dispenser 100 as a whole may supply dispenser statistics and trouble shooting information. For example, the delay times for the start of the pump/metering devices 200, the times for the vent and flush cycles, the portion cycles, etc. may be accessed through the computer user interface 150. This interface 150 also may be password or otherwise protected. The user interface 150 may communicate and/or be accessed as needed with a network or other source for troubleshooting or repair and for notifications or alerts, for example, of a potential incorrect dose of ingredients.

In use, the consumer may select the desired beverage from the computer user interface 150. The beverage dispenser 100 thus provides the consumer with the ability to create and blend numerous types of beverages as desired. The consumer can alter the ingredients as well as the intensity of the beverage to taste. As such, the consumer can submit an entire "recipe" for a beverage. The interface 150, via the control 160, thus instructs the individual pumps or meters 200 for the water source 170 and the appropriate macro-ingredients 180 and micro-ingredients 190 so as to dispense the appropriate ingredients in the appropriate proportions into the ingredient combination chamber 110. The ingredients pass through the chamber 110 and into the agitator 120 for mixing. The mixed beverage then flows into the consumer's cup 270. The flush diverter 130 then may be activated so as to provide a flow of water from the water source 170 through the ingredient combination chamber 110 and the agitator 120 for a given flow rate. Other fluids that may wet and clean also may be used. Different flow rates and flow timing may be employed, e.g., certain fluid streams may be added early or late, certain fluid streams may be pulsed, etc.

The use of the individual pumps or meters 200 for the water source 170 and the appropriate macro-ingredients 180 and micro-ingredients 190 thus provides the ability to dispense the appropriate ingredients in the appropriate proportions for a given flow rate during a continuous pour. In other words, as opposed to a conventional batch operation where a predetermined amount of ingredients are combined, the beverage dispenser 100 provides continuous mixing and flow in the correct ratios for a pour of any volume. The beverage dispenser 100 thus has applicability to conventional counter-top devices, vending devices, and various types of bottling or filing devices. Although the invention is described in terms of the beverage dispenser 100, the invention is applicable to the combination of any type of ingredients, wet, dry, or gaseous.

Possible beverages for use herein would include high pulp orange juice having water and high pulp orange juice concentrate; medium pulp orange juice having water, high pulp concentrate, and no pulp concentrate; no pulp orange juice having water and no pulp orange juice concentrate; an orange/grapefruit blend having water, no pulp orange juice concentrate, and grapefruit concentrate; hit punch having water, grape juice concentrate, apple juice concentrate, pear juice concentrate, flavor/color additive, and citric acid; lemonade having water, lemon juice concentrate, HFCS syrup, and flavor/color additive for lemonade; light lemonade having water, lemon juice concentrate, flavor/color additive for lemonade, artificial sweeteners or blends of artificial sweeteners, citric acid, potassium citrate; and sparkling juice having carbonated water and juice concentrate. Various combinations of juice concentrates could be used as a universal Juice base. Numerous 100% juice products can be created by adding small amounts of natural flavors/colors to the universal juice base, Functional additives also can be added. These additives can be bundled into packages wherein each package includes one or more vitamins or minerals. For example, the "bones" package may contain Vitamin D and Calcium, the "anti-oxidant" package may include Vitamins C and E and zinc, and the "heart" package may contain plant sterols and B vitamins.

Other fluids or ingredients also may be added downstream of the ingredient combination chamber 110 and/or the agitator 120. For example, a flow of carbonated water may be added about the outlet tube 125, the consumer's cup, or elsewhere to provide a carbonated beverage. By avoiding the combination chamber 110 and the agitator 120, the carbonated water does not promote over foaming of the beverage.

Referring again to FIG. 1, the beverage dispenser 100 also may include a consumer data system 600 in communication with the computerized user interface 150 and the control device 160. The consumer data system 600 may include a communications device 610. The communications device 610 may include a video touch screen, a video screen and keyboard, or any other type of conventional input/output device. The communications device 610 may be part of the computerized user interface 150 or a separate element. The communications device 610 may prompt a consumer to input data on various types of biometric, health, lifestyle, and/or other types of information. Based upon the consumer's input, the control device 160 may analyze the data and may suggest a beverage or beverage ingredients that may be ameliorative, beneficial, or simply amusing to the consumer in light of the data input.

Health parameters may include height, weight, blood pressure, blood glucose levels, insulin levels, cholesterol levels, bone density, heart rate, other types of metabolic information, body mass percentages, body temperature, smoking history, pregnancy, overall medical history, etc. Lifestyle questions could include mood, intensity of workouts, etc. Other types of categories may include time of day, outside temperature, current events, fan affiliations, etc. Any type of data may be requested.

Based upon the inputted data, the communications device 610 of the consumer data system 600 may suggest a beverage with various types of vitamins, minerals, herbal extracts, over the counter medicines, coloring, etc. A beverage with a specific amount of calories may be suggested. A beverage with the "bones" package, the "anti oxidant package", the "heart" package, or many other additives may be suggested. Once a beverage and/or additives are selected, the appropriate micro-ingredients 190 or other elements may be dispensed via the pumping or metering devices 200 as described above. Consumer data also may be stored and compared to current data.

In addition to the communication device 610 as described above, the consumer data system 600 also may include one or more biometric sensors 620. The biometric sensors 620 may include automated devices to gather the desired health data or other information. The biometric sensors 620 may include a scale, a blood pressure cuff, a breathalyzer, a blood analyzer, a hair analyzer, an EKG, wearable or non-wearable sensors, etc. Any type of monitoring device may be used herein. Any number of biometric sensors may be used together. The biometric sensors 620 also may be in communication with the control 160 as is described above.

Related applications that are filed herewith may be applicable to the disclosure herein. U.S. patent application Ser. No. 11/276,553, entitled "Methods and Apparatuses for Making Compositions Comprising an Acid and an Acid Degradable Component and/or Compositions Comprising a Plurality of Selectable Components"; U.S. patent application Ser. No. 11/276,550, entitled "Beverage Dispensing System"; U.S. patent application Ser. No. 11/276,548, entitled "Pump System with Calibration Curve"; and U.S. patent application Ser. No. 11/276,549, entitled "Dispensing Nozzle Assembly" are incorporated herein by reference.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A product mixing system, comprising:

an ingredient combination chamber;

the ingredient combination chamber comprising a diluent inlet for a diluent, a plurality of macro-ingredient inlets for one or more macro-ingredients, a plurality of micro-ingredient inlets for a plurality of micro-ingredients, and an outlet for mixing the diluent, the one or more macro-ingredients, and the plurality of micro-ingredients therein;

wherein the micro-ingredients comprise liquid micro-ingredients with reconstitution ratios in the range of about ten to one or higher;

means for agitation positioned downstream of the ingredient combination chamber;

a plurality of pumping or metering devices in communication with the diluent inlet, the plurality of macro-ingredient inlets, and the plurality of micro-ingredient inlets to dispense continuously a predetermined type and ratio of macro-ingredients, micro-ingredients, and diluent to the ingredient combination chamber and the means for agitation and to dispense diluent to the ingredient combination chamber and the means for agitation to flush the ingredient combination chamber and the means for agitation;

a flush fluid flow path adapted to direct a flush fluid stream from the means for agitation to a drain; and a flush diverter positioned downstream of the means for agitation for diverting the flush fluid stream.

2. The product mixing system of claim 1, wherein the flush diverter comprises a pivoting flow diverter positioned about the drain.

3. The product mixing system of claim 1, wherein the flush diverter comprises a linear diverter positioned about the drain.

4. The product mixing system of claim 3, wherein the linear diverter comprises a drawer operated by a solenoid.

5. The product mixing system of claim 1, further comprising a user interface.

6. The product mixing system of claim 5, wherein the user interface comprises a plurality of product selections.

7. The product mixing system of claim 5, wherein the user interface comprises a plurality of product use indicators to indicate that a product has been selected.

8. The product mixing system of claim 5, wherein the user interface comprises a plurality of additive selections.

9. The product mixing system of claim 5, wherein the user interface comprises a plurality of portion selections.

10. The product mixing system of claim 5, wherein the user interface comprises a plurality of intensity selections.

11. The product mixing system of claim 5, wherein the user interface comprises a consumer data system.

12. The product mixing system of claim 11, wherein the consumer data system comprises a communications device.

13. The product mixing system of claim 11, wherein the consumer data system comprises a biometric sensor.

14. The product mixing stream of claim 1, wherein the flush diverter is selectively activated.

15. The product mixing stream of claim 1, wherein the flow diverter diverts the flush fluid stream from an exit tube to the drain.

* * * * *